US009178268B2

(12) United States Patent
Zhu et al.

(10) Patent No.: US 9,178,268 B2
(45) Date of Patent: Nov. 3, 2015

(54) ANTENNAS INTEGRATED WITH SPEAKERS AND METHODS FOR SUPPRESSING CAVITY MODES

(75) Inventors: Jiang Zhu, Sunnyvale, CA (US); Qingxiang Li, Mountain View, CA (US); Rodney A. Gomez Angulo, Sunnyvale, CA (US); Miroslav Samardzija, Mountain View, CA (US); Gordon Coutts, Sunnyvale, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 443 days.

(21) Appl. No.: 13/540,999

(22) Filed: Jul. 3, 2012

(65) Prior Publication Data

US 2014/0009344 A1 Jan. 9, 2014

(51) Int. Cl.

| | |
|---|---|
| ***H01Q 1/24*** | (2006.01) |
| ***H01Q 1/22*** | (2006.01) |
| ***H01Q 9/42*** | (2006.01) |

(52) U.S. Cl.

CPC ..... *H01Q 1/2266* (2013.01); *H01Q 1/243* (2013.01); *H01Q 9/42* (2013.01)

(58) Field of Classification Search

USPC ..... 343/702; 455/575.1

See application file for complete search history.

(56) References Cited

U.S. PATENT DOCUMENTS

| | | | |
|---|---|---|---|
| 3,573,834 | A | 4/1971 | McCabe et al. |
| 4,733,245 | A | 3/1988 | Mussler |
| 5,461,393 | A | 10/1995 | Gordon |
| 5,703,600 | A | 12/1997 | Burrell et al. |
| 5,877,728 | A | 3/1999 | Wu et al. |
| 5,914,693 | A | 6/1999 | Takei |
| 6,081,729 | A | 6/2000 | Bauerschmidt et al. |
| 6,127,987 | A | 10/2000 | Maruyama et al. |
| 6,225,959 | B1 | 5/2001 | Gordon |
| 6,339,400 | B1 | 1/2002 | Flint et al. |
| 6,380,930 | B1 | 4/2002 | Van Ruymbeke |

(Continued)

FOREIGN PATENT DOCUMENTS

| | | | |
|---|---|---|---|
| CN | 1256802 | A | 6/2000 |
| CN | 2850006 | Y | 12/2006 |

(Continued)

OTHER PUBLICATIONS

Zhu et al., U.S. Appl. No. 13/629,061, filed Sep. 27, 2012.

*Primary Examiner* — Dieu H Duong

(74) *Attorney, Agent, or Firm* — Treyz Law Group; G. Victor Treyz; Michael H. Lyons

(57) ABSTRACT

An electronic device may be provided with a speaker box antenna for transmitting and receiving radio-frequency signals. A speaker box antenna may be formed from a hollow dielectric speaker box containing a speaker driver. An opening in the speaker box adjacent to the speaker driver may be aligned with a speaker port opening in a conductive electronic device housing structure. The speaker box may be surrounded by conductive structures that form a cavity for the antenna. The conductive structures may include parts of the conductive electronic device housing structure. The speaker box may have opposing upper and lower surfaces. Metal plates may form parts of the upper and lower surfaces and may be shorted together using a conductive layer such as a strip of metal tape. Frequencies of operation may be selected for the antenna that suppress undesired cavity modes and enhance antenna performance.

20 Claims, 9 Drawing Sheets

(56) References Cited

U.S. PATENT DOCUMENTS

| | | | | |
|---|---|---|---|---|
| 6,621,466 | B2 | 9/2003 | Kuck | |
| 6,646,605 | B2 | 11/2003 | McKinzie et al. | |
| 6,677,909 | B2 | 1/2004 | Sun et al. | |
| 6,831,607 | B2 | 12/2004 | Hebron et al. | |
| 6,859,186 | B2 | 2/2005 | Lizalek et al. | |
| 6,861,995 | B2 | 3/2005 | Kuo et al. | |
| 6,894,650 | B2 | 5/2005 | Darden et al. | |
| 7,126,553 | B1 | 10/2006 | Fink et al. | |
| 7,199,756 | B2 | 4/2007 | Cha et al. | |
| 7,233,678 | B2 | 6/2007 | Erixon et al. | |
| 7,342,539 | B2 | 3/2008 | Rosenberg et al. | |
| 7,345,634 | B2 | 3/2008 | Ozkar et al. | |
| 7,405,704 | B1 | 7/2008 | Lin et al. | |
| 7,446,729 | B2 | 11/2008 | Maruyama et al. | |
| 7,463,121 | B2 | 12/2008 | D'Ostilio | |
| 7,486,242 | B2 | 2/2009 | Gala Gala et al. | |
| 7,629,930 | B2 | 12/2009 | Murch et al. | |
| 7,688,276 | B2 | 3/2010 | Quintero Illera et al. | |
| 7,804,453 | B2 | 9/2010 | Chiang et al. | |
| 7,813,770 | B2 * | 10/2010 | Ho et al. | 455/569.1 |
| 8,054,232 | B2 | 11/2011 | Chiang et al. | |
| 8,325,094 | B2 | 12/2012 | Ayala Vazquez et al. | |
| 8,773,310 | B2 | 7/2014 | Shiu et al. | |
| 2002/0149523 | A1 | 10/2002 | Fang et al. | |
| 2002/0163468 | A1 * | 11/2002 | Anderson | 343/700 MS |
| 2003/0090426 | A1 | 5/2003 | Sun et al. | |
| 2004/0051670 | A1 | 3/2004 | Sato | |
| 2004/0075611 | A1 | 4/2004 | Kenoun et al. | |
| 2004/0097270 | A1 | 5/2004 | Cha et al. | |
| 2004/0201532 | A1 | 10/2004 | Apostolos et al. | |
| 2005/0017914 | A1 | 1/2005 | Huang | |
| 2005/0233781 | A1 | 10/2005 | Erixon et al. | |
| 2006/0244663 | A1 | 11/2006 | Fleck et al. | |
| 2007/0057855 | A1 | 3/2007 | Mizoguchi et al. | |
| 2007/0115187 | A1 | 5/2007 | Zhang et al. | |
| 2007/0120740 | A1 | 5/2007 | Iellici et al. | |
| 2007/0176846 | A1 | 8/2007 | Vazquez et al. | |
| 2007/0216594 | A1 | 9/2007 | Uno et al. | |
| 2008/0018551 | A1 | 1/2008 | Cheng et al. | |
| 2009/0153412 | A1 | 6/2009 | Chiang et al. | |
| 2009/0262029 | A1 | 10/2009 | Chiang et al. | |
| 2010/0060529 | A1 | 3/2010 | Schlub et al. | |
| 2010/0073241 | A1 | 3/2010 | Ayala Vazquez et al. | |
| 2010/0156741 | A1 | 6/2010 | Vazquez et al. | |
| 2010/0182205 | A1 | 7/2010 | Chiang | |
| 2010/0231481 | A1 | 9/2010 | Chiang et al. | |
| 2010/0321249 | A1 | 12/2010 | Chiang et al. | |
| 2010/0321253 | A1 | 12/2010 | Ayala Vazquez et al. | |
| 2011/0006953 | A1 | 1/2011 | Chiang et al. | |
| 2011/0050508 | A1 | 3/2011 | Guterman et al. | |
| 2011/0050509 | A1 | 3/2011 | Ayala Vazquez et al. | |
| 2011/0111719 | A1 | 5/2011 | Man et al. | |
| 2011/0241943 | A1 | 10/2011 | Shiu et al. | |
| 2011/0241948 | A1 | 10/2011 | Bevelacqua et al. | |
| 2012/0194393 | A1 * | 8/2012 | Uttermann et al. | 343/702 |
| 2012/0218695 | A1 | 8/2012 | Sakai | |
| 2013/0050032 | A1 * | 2/2013 | Shiu et al. | 343/702 |
| 2013/0293424 | A1 | 11/2013 | Zhu et al. | |
| 2013/0328730 | A1 | 12/2013 | Gutterman et al. | |
| 2014/0085161 | A1 | 3/2014 | Zhu et al. | |
| 2014/0184453 | A1 | 7/2014 | Chen et al. | |

FOREIGN PATENT DOCUMENTS

| | | |
|---|---|---|
| EP | 1329979 | 7/2003 |
| EP | 1329985 | 7/2003 |
| EP | 1758348 | 2/2007 |
| EP | 1950834 | 7/2008 |
| EP | 1483880 | 1/2010 |
| JP | HEI 09-03233 | 3/1997 |
| KR | 10-2004-0044211 | 5/2004 |
| TW | 201004024 | 1/2010 |
| WO | 99/36988 | 7/1999 |
| WO | 03077507 | 9/2003 |

* cited by examiner

ANTENNAS INTEGRATED WITH SPEAKERS AND METHODS FOR SUPPRESSING CAVITY MODES

BACKGROUND

This relates generally to electronic devices, and more particularly, to antennas for electronic devices.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components and electronic components. Because conductive components can affect radio-frequency performance, care must be taken when incorporating antennas into an electronic device that includes conductive structures. For example, care must be taken to ensure that the antennas and wireless circuitry in a device are able to exhibit satisfactory performance over a range of operating frequencies.

It would therefore be desirable to be able to provide wireless electronic devices with improved antenna structures.

SUMMARY

Electronic devices may be provided that contain wireless communications circuitry. The wireless communications circuitry may include radio-frequency transceiver circuitry and antennas.

An electronic device may be provided with a speaker box antenna for transmitting and receiving radio-frequency signals. The speaker box antenna may have a conductive cavity supported by a speaker box. The speaker box may be formed from a hollow dielectric structure having an air-filled interior. A speaker driver may be mounted in the air-filled interior of the speaker box.

An opening in the speaker box may be aligned with a speaker port opening in a conductive electronic device housing structure. The speaker box may be surrounded by conductive structures that form the cavity for the antenna. The conductive structures may include parts of the conductive electronic device housing structure. The conductive structures may also include electrical components such as button components.

The speaker box may have opposing upper and lower surfaces. Metal plates may form parts of the upper and lower surfaces and may be shorted together using a conductive layer such as a strip of metal tape. The metal plates and metal tape may form part of the conductive structures that form the cavity for the antenna. The conductive cavity of the antenna may be configured to suppress undesired cavity modes and enhance antenna performance.

Further features of the invention, its nature and various advantages will be more apparent from the accompanying drawings and the following detailed description of the preferred embodiments.

DETAILED DESCRIPTION

Figure 1:
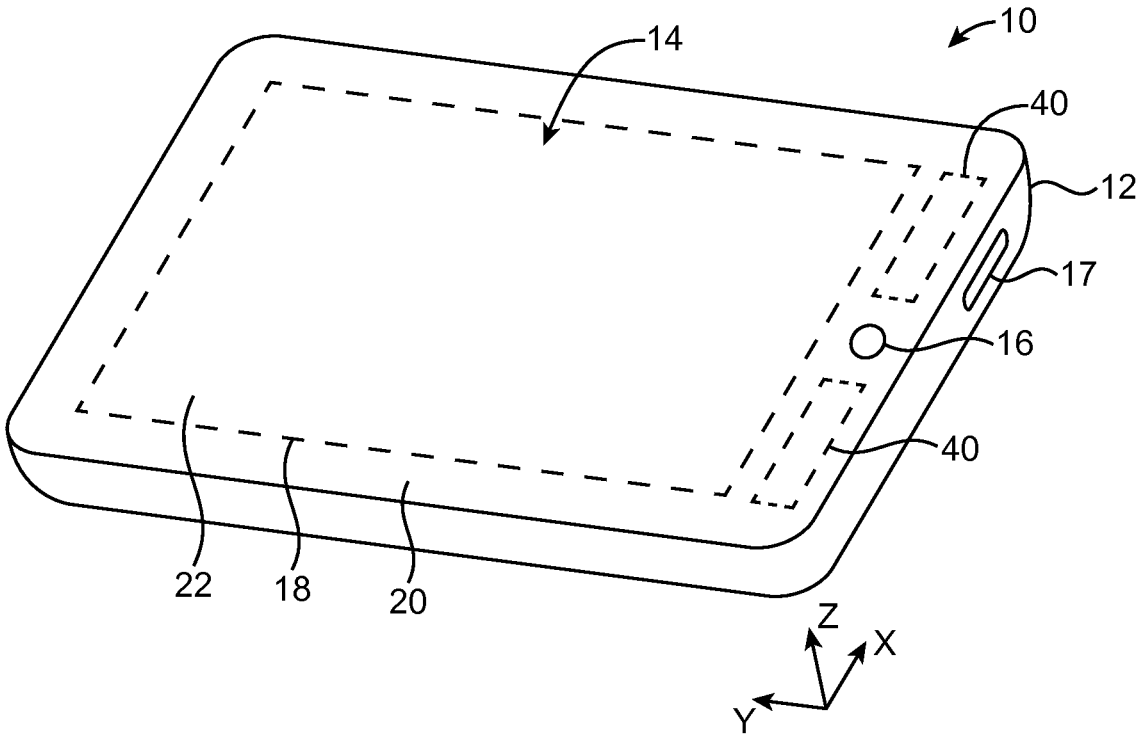
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in one or more wireless communications bands. The wireless communications circuitry may include one or more antennas.

The antennas may include one or more cavity antennas. Cavity-backed antennas may include an antenna resonating element and an associated conductive cavity. The cavity may be formed from conductive structures mounted to a support structure such as a speaker box. Conductive antenna structures may also be formed using conductive electronic device structures such as portions of conductive housing structures. Examples of conductive housing structures that may be used in forming an antenna (e.g., a cavity for an antenna or an antenna resonating element) include conductive internal support structures such as sheet metal structures and other planar conductive members, conductive housing walls, a peripheral conductive housing member such as a display bezel, peripheral conductive housing structures such as conductive housing sidewalls, a conductive planar rear housing wall and other conductive housing walls, or other conductive structures. Conductive structures for antennas may also be formed from parts of electronic components, such as switches (e.g., button components for a menu button or other button), integrated circuits, display module structures, flexible printed circuits associated with carrying signals for components such as display components, etc. Shielding tape, shielding cans, conductive foam, and other conductive materials within an electronic device may also be used in forming antenna structures.

Antenna structures such as antenna resonating element structures may be formed from patterned metal foil or other metal structures. If desired, antenna structures may be formed from conductive traces such as metal traces on a substrate. The substrate may be a plastic support structure or other dielectric structure, a rigid printed circuit board substrate such as a fiberglass-filled epoxy substrate (e.g., FR4), a flexible printed circuit ("flex circuit") formed from a sheet of polyimide or other flexible polymer, or other substrate material. If desired, antenna structures may be formed using combinations of these approaches. For example, an antenna may be formed partly from metal structures (e.g., ground conductor structures) supported by and/or adjacent to a plastic support structure such as a hollow speaker box and may be formed partly from metal traces on a printed circuit (e.g., patterned traces on a rigid printed circuit board or a flexible printed circuit for forming antenna resonating element structures).

As shown in FIG. 1, electronic device 10 may have a housing such as housing 12. Housing 12 may be formed from conductive structures (e.g., metal) or may be formed from dielectric structures (e.g., glass, plastic, ceramic, etc.). Antenna windows formed from plastic or other dielectric material may, if desired, be formed in conductive housing structures. An antenna for device 10 may be mounted adjacent to a dielectric housing wall or may be mounted under an antenna window structure so that the antenna window structure overlaps the antenna. During operation, radio-frequency antenna signals may pass through dielectric antenna windows and other dielectric structures in device 10. If desired, device 10 may have a display with a cover layer. Antennas for device 10 may be mounted so that antenna signals pass through the display cover layer in addition to or instead of passing through a dielectric antenna window.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may have a display such as display 14 that is mounted in housing 12. Display 14 may, for example, be a touch screen that incorporates capacitive touch electrodes or may be insensitive to touch. A touch sensor for display 14 may be formed from capacitive touch sensor electrodes, a resistive touch array, touch sensor structures based on acoustic touch, optical touch, or force-based touch technologies, or other suitable touch sensors.

Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A cover layer may cover the surface of display 14 or a display layer such as a color filter layer or other portion of a display may be used as the uppermost (or nearly uppermost) layer in display 14.

The display cover layer or other outer display layer may be formed from a transparent glass sheet, a clear plastic layer, or other transparent member. As shown in FIG. 1, openings may be formed in the outermost display layer to accommodate components such as button 16.

Display 14 may have an active portion and, if desired, may have an inactive portion. The active portion of display 14 may contain active image pixels for displaying images to a user of device 10. The inactive portion of display 14 may be free of active pixels. The active portion of display 14 may lie within a region such as central rectangular region 22 (bounded by rectangular outline 18). Inactive portion 20 of display 14 may surround the edges of active region 22 in a rectangular ring shape.

In inactive region 20, the underside of the display cover layer for display 14 or other portions of the display layers in display 14 may be coated with an opaque masking layer. The opaque masking layer may be formed from an opaque material such as an opaque polymer (e.g., black ink, white ink, a coating of a different color, etc.). The opaque masking layer may be used to block interior device components from view by a user of device 10. The opaque masking layer may, if desired, be sufficiently thin and/or formed from a sufficiently non-conductive material to be radio transparent. This type of configuration may be used in configurations in which antenna structures are formed under inactive region 20. As shown in FIG. 1, for example, antenna structures such as one or more antennas 40 may be mounted in housing 12 so that inactive region 20 overlaps the antenna structures.

One or more antennas 40 may be mounted adjacent to audio port 17. For example, a conductive cavity for a cavity antenna may be formed from conductive structures that are attached to or mounted adjacent to a speaker box or that otherwise surround the speaker box. The speaker box may therefore form as a cavity support structure for the cavity antenna. The speaker box may also contain a speaker driver for producing sound that passes through an opening in housing 12 (i.e., speaker port 17).

Housing 12, which may sometimes be referred to as a case, may be formed of plastic, glass, ceramics, fiber composites, metal (e.g., stainless steel, aluminum, etc.), other suitable materials, or a combination of these materials. In some situations, housing 12 or parts of housing 12 may be formed from dielectric or other low-conductivity material. In other situations, housing 12 or at least some of the structures that make up housing 12 may be formed from metal elements.

In configurations for device 10 in which housing 12 is formed from conductive materials such as metal, antennas 40 may be mounted under the display cover layer for display 14 as shown in FIG. 1 (e.g., under inactive region 20) and/or antennas 40 may be mounted adjacent to one or more dielectric antenna windows in housing 12. During operation, radio-frequency antenna signals can pass through the portion of inactive region 20 of the display cover layer that overlaps antennas 40 (and, if a dielectric window structure is used, antenna signals may pass through the window structure). In general, antennas 40 may be located in any suitable location in device housing 12 (e.g., along the edges of display 14, in corners of device 10, under an antenna window or other dielectric structure on a rear surface of housing 12, etc.).

Device 10 may have a single antenna or multiple antennas. In configurations in which multiple antennas are present, the antennas may be used to implement an antenna array in which signals for multiple identical data streams (e.g., Code Division Multiple Access data streams) are combined to improve signal quality or may be used to implement a multiple-input-multiple-output (MIMO) antenna scheme that enhances performance by handling multiple independent data streams (e.g., independent Long Term Evolution data streams). Multiple antennas may also be used to implement an antenna diversity scheme in which device 10 activates and inactivates each antenna based on its real time performance (e.g., based on received signal quality measurements). In a device with wireless local area network wireless circuitry, the device may use an array of antennas 40 to transmit and receive wireless local area network signals (e.g., IEEE 802.11n traffic). Multiple antennas may be used together in both transmit and receive modes of operation or may only be used together during only signal reception operations or only signal transmission operations.

Antennas in device 10 may be used to support any communications bands of interest. For example, device 10 may include antenna structures for supporting wireless local area network communications such as IEEE 802.11 communications (e.g., communications in bands such as the IEEE 802.11 bands at 2.4 GHz and 5 GHz) or Bluetooth® communications, voice and data cellular telephone communications, global positioning system (GPS) communications or other satellite navigation system communications, etc.

Figure 2:
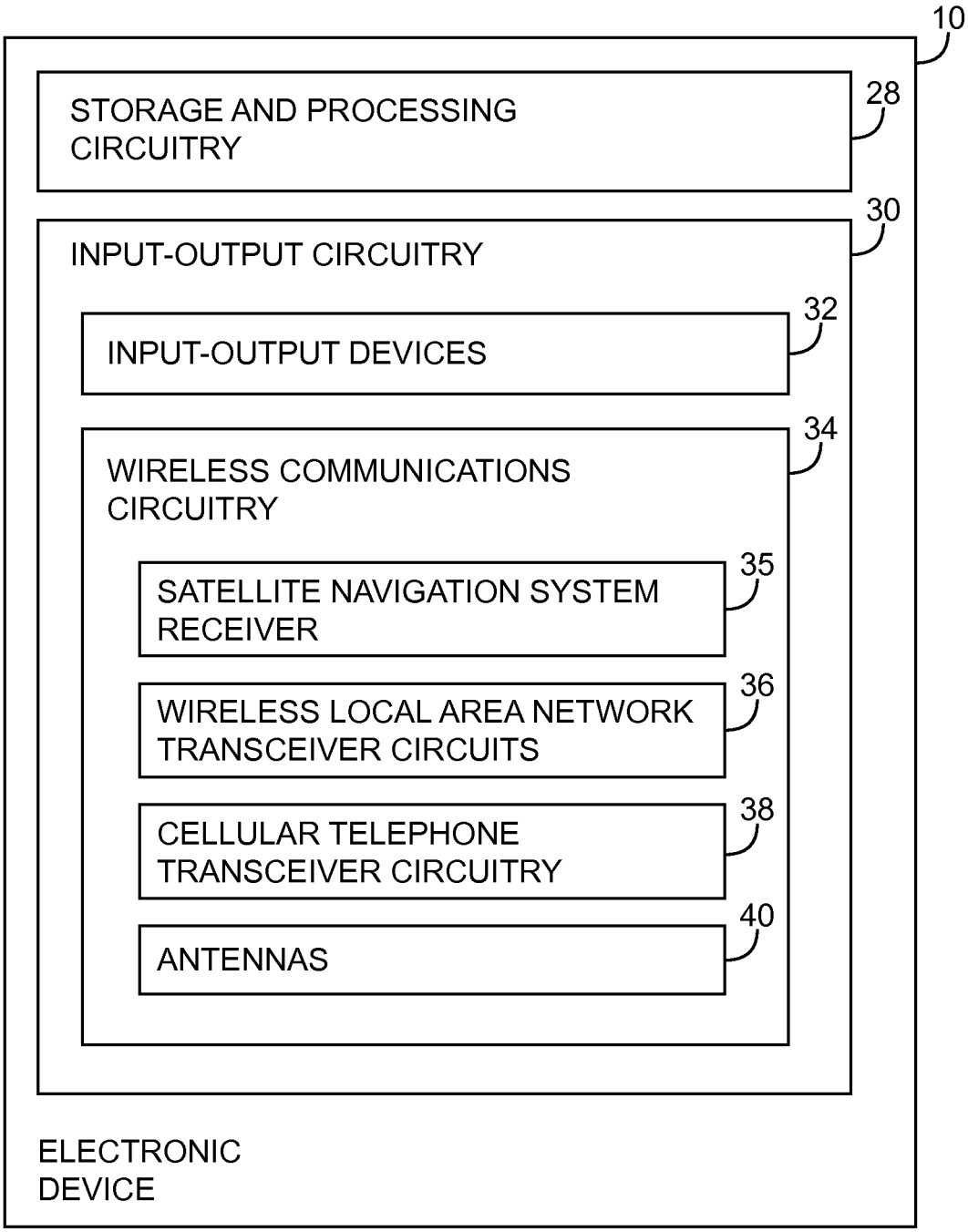
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols such as IEEE 802.11 protocols—sometimes referred to as WiFi® and protocols for other short-range wireless communications links such as the Bluetooth® protocol, cellular telephone protocols, etc.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry 35 such as Global Positioning System (GPS) receiver circuitry (e.g., for receiving satellite positioning signals at 1575 MHz) or may include satellite navigation system receiver circuitry associated with other satellite navigation systems. Wireless local area network transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2200 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, near field communications circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may, if desired, include on or more cavity antennas.

Figure 3:
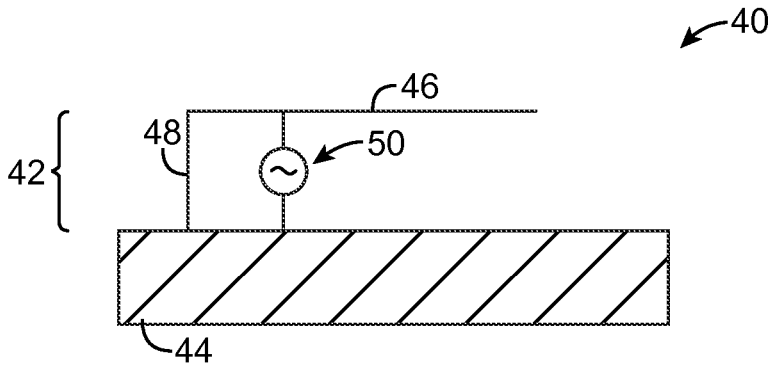
FIG. 3 is a schematic diagram of an illustrative antenna in accordance with an embodiment of the present invention.

A schematic diagram of an illustrative configuration for an antenna in device 10 is shown in FIG. 3. In the example of FIG. 3, antenna 40 is an inverted-F antenna. This is merely illustrative. Antenna 40 may, in general, be based on any suitable type of antenna (e.g., a loop antenna, a patch antenna, a monopole antenna, a dipole antenna, a directly fed antenna, an indirectly fed antenna, a slot antenna, a planar inverted-F antenna, other antenna types, or hybrids formed from two or more of these antennas).

As shown in FIG. 3, inverted-F antenna 40 may include an antenna resonating element such as antenna resonating element 42 and an antenna ground such as antenna ground 44. Antenna resonating element 46 may have a main antenna resonating element arm such as arm 46. Arm 46 may have one or more branches. Short circuit branch 48 may be used to couple resonating element arm 46 to ground 44. Antenna feed 50 may be coupled between antenna resonating element arm 46 and ground 44 in parallel with short circuit branch 48.

Figure 4:
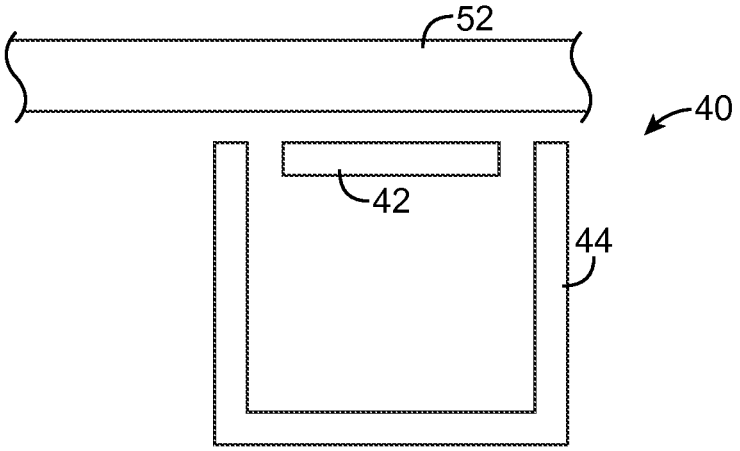
FIG. 4 is a cross-sectional side view of a cavity antenna in accordance with an embodiment of the present invention.

In a cavity antenna, a conductive cavity structure may be configured to form antenna ground 44. A cross-sectional side view of an illustrative cavity antenna is shown in FIG. 4. As shown in FIG. 4, antenna 40 may include an antenna resonating element such as antenna resonating element 42 and may include a conductive cavity such as conductive ground cavity 44. Display layer 52 may overlap antenna resonating element 42 and cavity 44. During operation, radio-frequency signals associated with antenna 40 (e.g., signals transmitted and/or received using resonating element 42) may pass through layer 52 of display 14. Layer 52 may be a display cover layer, a color filter layer, or other display layers associated with display 14 (as examples).

Figure 5:
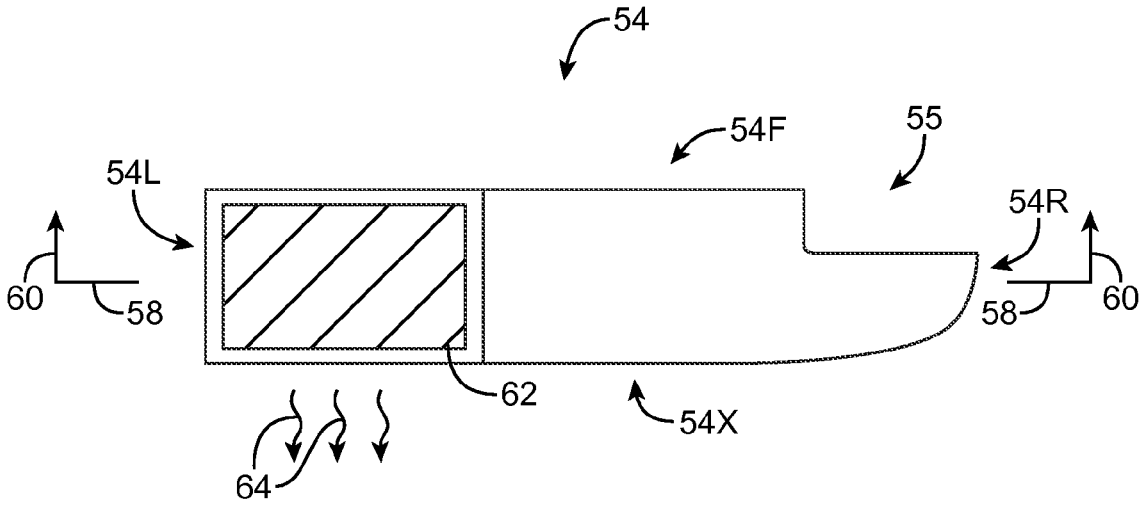
FIG. 5 is a top view of a speaker box in accordance with an embodiment of the present invention.

If desired, the conductive structures that form antenna cavity 44 may be mounted on a support structure such as a speaker box. FIG. 5 is a top view of an illustrative speaker box of the type that may be used to provide sound to audio port 17. A speaker driver may be mounted within speaker box 54 for producing sound 64. Speaker box 54 may be aligned with port 17 so that sound 64 passes through port 17 during operation. Speaker box 54 may be formed from plastic, metal, fiber-based composites, other materials, or combinations of these materials. As an example, speaker box 54 may be formed from a hollow molded plastic structure having opposing upper and lower walls. Speaker box 54 may have a roughly rectangular shape. As shown in FIG. 5, for example, speaker box 54 may have walls such as left wall 54L, right wall 54R, front wall 54F, and rear wall 54X that surround the periphery of speaker box 54. With this type of configuration, speaker box 54 may exhibit a roughly rectangular footprint (i.e., speaker box 54 may occupy an approximately rectangular area when viewed from above as in FIG. 5). Curved edge portion 54CE may be used to accommodate speaker box 54 within a curved corner portion of housing 12. Recessed portion 55 may be used to accommodate a flexible printed circuit cable for display 14 or other components in device 10. If desired, speaker box 54 may have a footprint of other shapes. The example of FIG. 5 is merely illustrative.

Metal structures such as metal plate 62 may be attached to speaker box 54 or embedded within the walls of speaker box 54, if desired. As shown in FIG. 5, for example, metal plate 62 may be formed on the upper wall of speaker box 54 (e.g., plate 62 may form part of the upper surface of speaker box 54).

Figure 6:
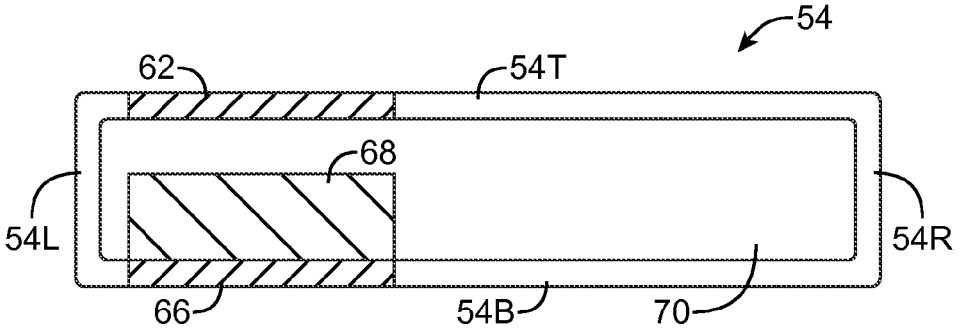
FIG. 6 is a cross-sectional side view of the speaker box of FIG. 5 in accordance with an embodiment of the present invention.

A cross-sectional side view of speaker box 54 taken along line 58 of FIG. 5 and viewed in direction 60 is shown in FIG. 6. As shown in FIG. 6, metal plate 52 may form part of upper speaker box wall 54T. Speaker box 54 may also have an opposing planar wall structure such as lower wall 54B. The walls of speaker box 54 form a hollow rectangular-box-shaped air-filled interior region (interior 70). Speaker driver 68 may be mounted in air-filled interior region 70. During operation of device 10, speaker driver 68 may produce sound 64 (FIG. 5). An opening in rear wall 54X (FIG. 5) may allow sound to escape through speaker port 17 (FIG. 1). A planar metal structure such as metal plate 66 may be formed in lower wall 54B. Plate 66 may, for example, be formed below speaker driver 68 and may form part of the lower surface of speaker box 54. Metal plate 62 may overlap speaker driver 68 and metal plate 66. Metal plate 66 may overlap speaker box 54 and plate 62. Metals such as aluminum, stainless steel, and other metals may be used in forming structures such as metal plate 62 and metal plate 66. In some configurations, metal wall structures may be stronger than plastic wall structures of the same thickness, so the use of metal plates in forming parts of the walls in speaker box 54 may help allow the dimensions of speaker box 54 to be minimized.

Figure 7:
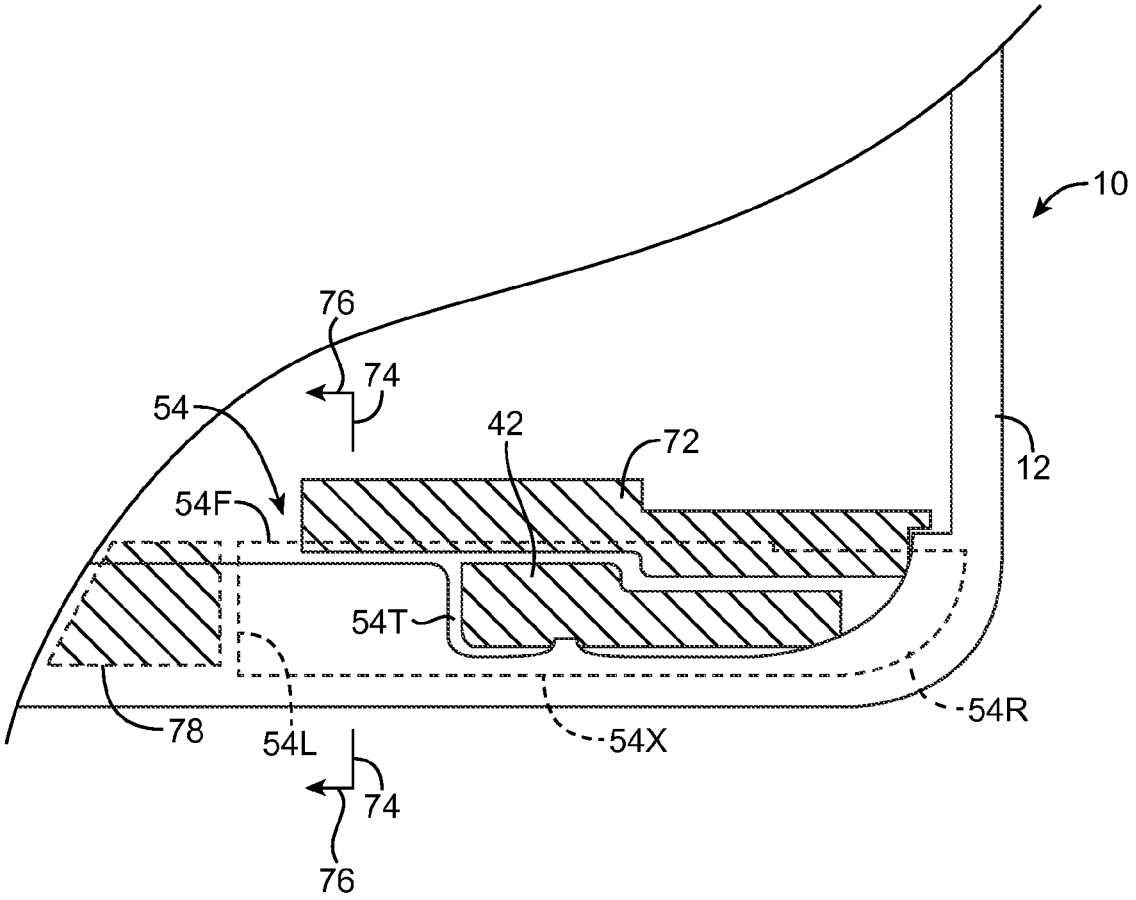
FIG. 7 is a top view of an illustrative speaker box mounted in a corner portion of an electronic device housing in accordance with an embodiment of the present invention.

FIG. 7 is a top view of a corner portion of device 10 showing how speaker box 54 may be surrounded by conductive structures such as housing 12 and flexible printed circuit 72. Flexible printed circuit 72 may contain metal traces that form signal paths for conveying signals associated with operating a touch sensor array for display 14 between the touch sensor array and circuitry on a printed circuit board. Metal tape, display structures, and other conductive structures may run along wall 54F of speaker box 54. Wall 54X may be covered by portions of housing 12. Portions of housing 12 may also cover part of upper speaker box wall 54T and lower speaker box wall 54L (FIG. 6). An edge portion of printed circuit 72 may cover part of upper speaker box wall 54T. Conductive structures 78 such as conductive switch structures and other conductive structures associated with button 16 of FIG. 1 or other button components may cover speaker box wall 54L. Opposing end wall 54R may be covered by portions of housing 12. By covering the walls of speaker box 54 in this way, the conductive structures surrounding speaker box 54 allow speaker box 54 to form a conductive cavity for antenna 40 (e.g., an elongated rectangular box-shaped cavity having opposing ends, opposing front and rear surfaces, and opposing upper and lower surfaces).

Antenna resonating element 42 may be formed from conductive metal traces on a rigid printed circuit or conductive metal traces on a flexible printed circuit (as examples). Antenna resonating element 42 may be mounted in an opening in the upper surface of the antenna cavity formed by speaker box 54, as illustrated by antenna cavity 44 in antenna 40 of FIG. 4. In a fully assembled version of device 10, dielectric display layers such as display layer 52 of FIG. 4 (e.g., a portion of a color filter layer, thin-film transistor layer, and/or a display cover layer) may cover speaker box 54, including antenna resonating element 42 and the other structures shown in the corner of device 10 of FIG. 7.

Figure 8:
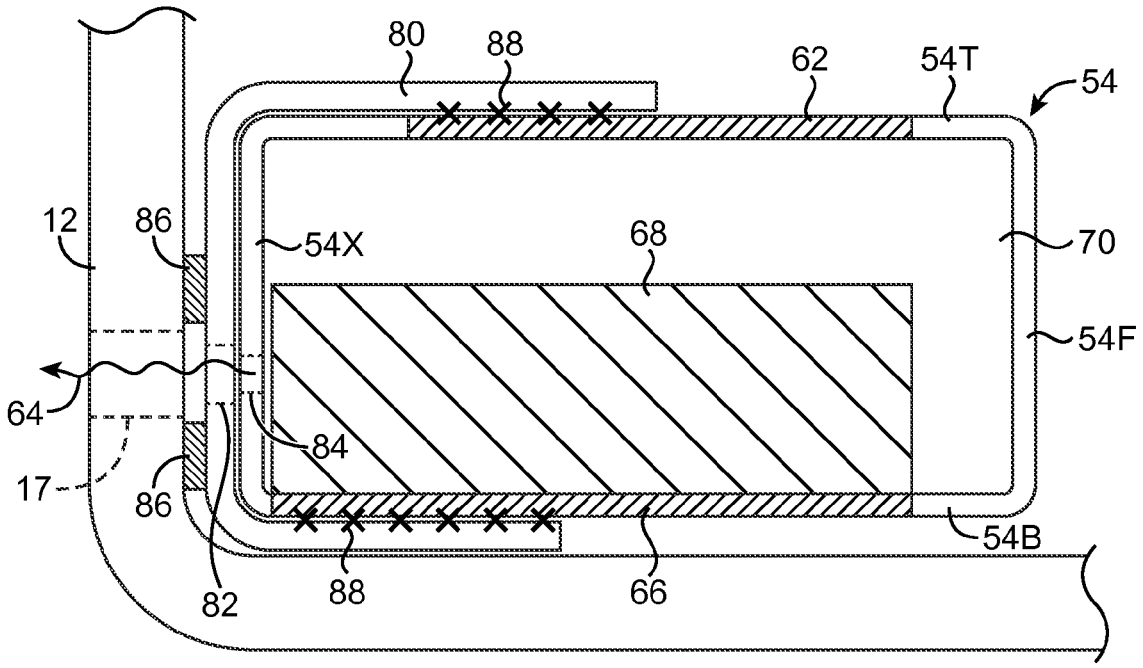
FIG. 8 is a cross-sectional side view of a speaker box adjacent to a housing wall in an electronic device in accordance with an embodiment of the present invention.

FIG. 8 is a cross-sectional end view of speaker box 54 taken along line 74 of FIG. 7 (at the left end of speaker box 54) and viewed in direction 76. As shown in FIG. 8, a layer of conductive tape such as tape 80 may be wrapped around the side of speaker box 54 at one of the opposing ends of the elongated speaker box such as the left end of speaker box 54 adjacent to wall 54L. Conductive tape 80 may be formed from a layer of metal such as copper, from a conductive fabric, or other conductive materials. Conductive adhesive, welds, fasteners, or other conductive attachment mechanisms 88 may be used to short conductive tape 80 to upper speaker box plate 62 and lower speaker box plate 66.

A portion of tape 80 may cover rear speaker box wall 54X. Speaker box wall 54X may have an opening such as opening 84. Tape 80 may have a mating opening such as opening 82 that is aligned with opening 84. Gasket 86 may surround opening 82 and may be interposed between housing wall 12 and tape 80. By aligning openings 84, 82, and 17 in housing wall 12 with the mating opening formed in the center of gasket 86, sound 64 may be allowed to pass from speaker driver 68 through these openings to the exterior of device 10.

The shape of openings 84, 82, and 17 may be rectangular (so that gasket 86 has a rectangular ring shape), may be circular (so that gasket 86 has a circular ring shape), or may have other suitable matched shapes.

Figure 9:
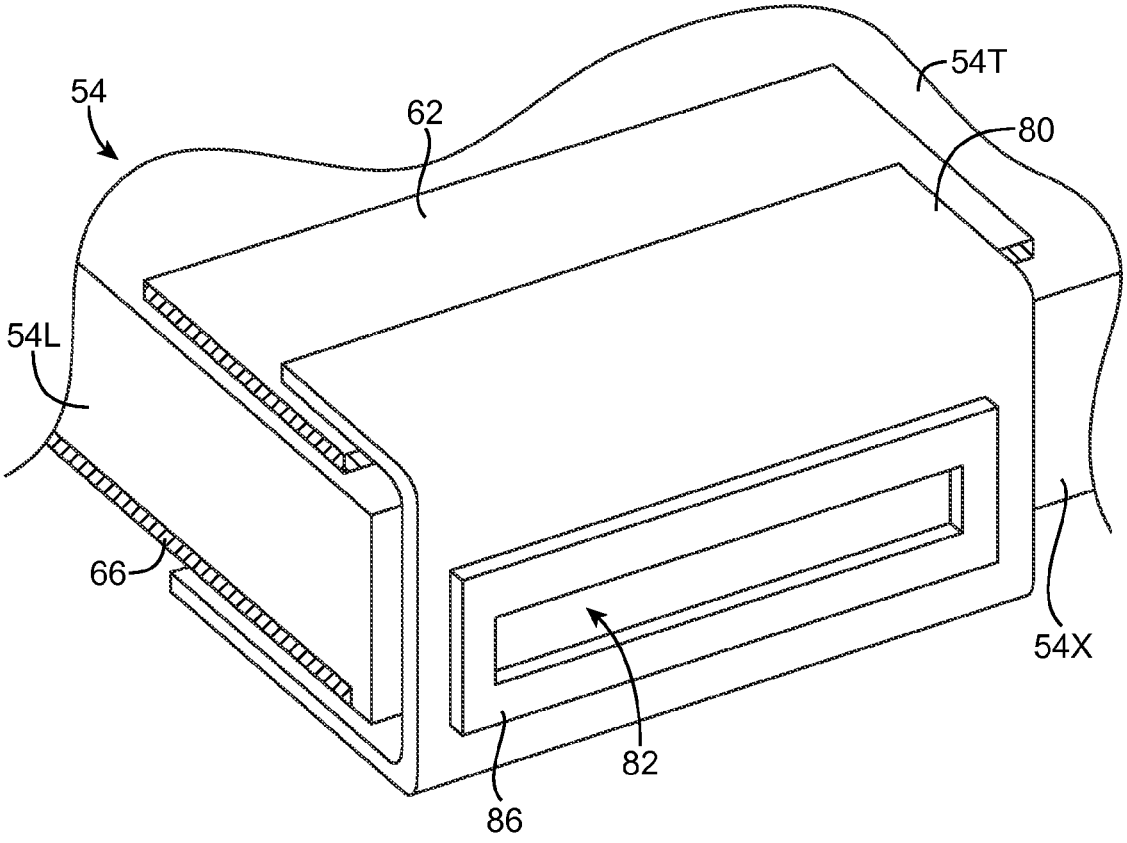
FIG. 9 is a perspective view of a portion of a speaker box in the vicinity of an audio port in accordance with an embodiment of the present invention.

FIG. 9 is a perspective view of a portion of speaker box 54 showing how conductive tape 80 may wrap around sidewall portion 54X and may short plates 62 and 66 to each other, thereby grounding plate 62 and plate 66. Tape 80 may wrap around speaker box 54 along the entire length of speaker box wall 54X or may, as shown in FIG. 9, only wrap around speaker box 54 in the portion of speaker box 54 near the left end of speaker box 54 that includes plates 62 and 66 (e.g., the left half of speaker box 54). Grounding plate 62 to plate 66 in this way influences the loading on antenna 40 and can be used to adjust the supported cavity modes in cavity 44 for a frequency band of interest and thereby enhance antenna performance.

Figure 10:
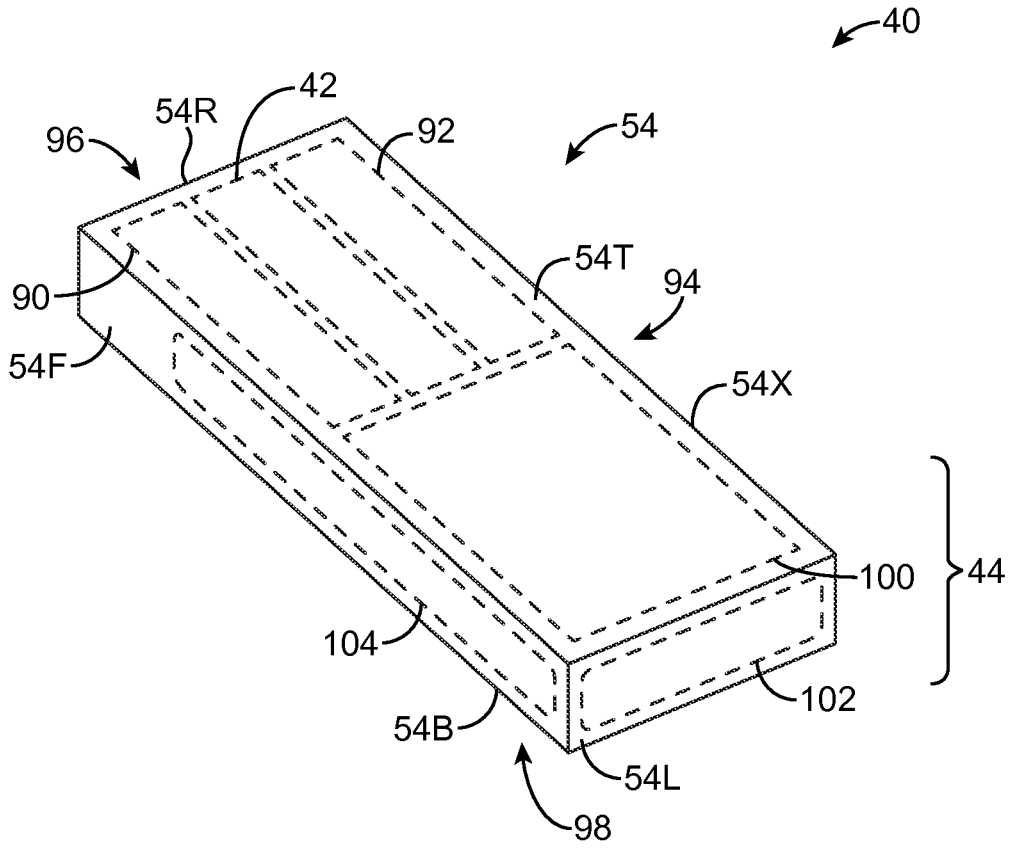
FIG. 10 is a simplified perspective view of an illustrative speaker box that may be used in forming a cavity antenna in accordance with an embodiment of the present invention.

Cavity 44 for cavity antenna 40 may be formed by the conductive structure that surround speaker box 54. As shown in FIG. 10, speaker box 54 may roughly have the shape of a six-sided rectangular box. Housing structures 12 may serve as conductive ground structures 96, 94, and 98 on walls 54R, 54X, and 54B, respectively. Conductive ground structures 102 for covering wall 54L may be formed from electrical components in device 10 such as button structures associated with button 16 (e.g., a dome switch, a button flexible printed circuit with button switch traces, metal support structures, etc.). Conductive ground structures 90 may be formed by an overlapping display flexible printed circuit cable such as cable 72 of FIG. 7 or other conductive material. Conductive ground structures 92 may be formed from an overlapping portion of housing 12. Conductive ground structures 100 may be formed by metal plate 62. Tape 80 and lower plate 66 may also form conductive ground structures surrounding box 54.

Speaker box 54 may have an elongated length along which elongated front wall 54F runs. Front wall 54F of speaker box 54 may be covered by conductive display components and, if desired, layer of conductive tape. The conductive tape may, as an example, cover a portion of wall 54F, as shown in FIG. 10, while leaving an end portion (e.g., a fraction of the length of wall 54F adjacent to right end 54R of box 54) uncovered by tape. The use of a partly covered configuration for wall 54F may help adjust the supported cavity modes in cavity 44 for a frequency band of interest and thereby enhance antenna performance.

Antenna resonating element 42 of antenna 40 may be mounted on the upper surface of speaker box 54, so that the ground structures that surround speaker box 54 serve as antenna cavity 44 for cavity antenna 40.

Figure 11:
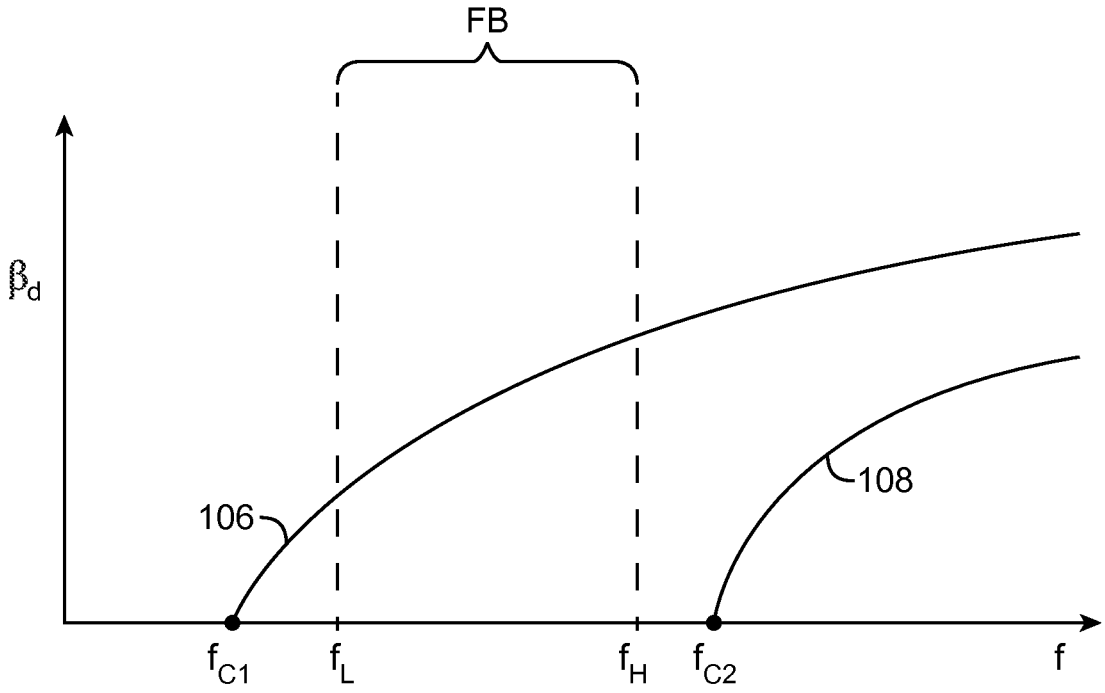
FIG. 11 is a graph showing how an antenna cavity may be configured so that a frequency band of operation lies between cutoff frequencies for successive cavity modes in accordance with an embodiment of the present invention.

The conductive materials that surround speaker box 54 to form cavity 44 such as tape 104, tape 80, plates 62 and 66, and the other portions of cavity 44 may be configured to suppress undesired cavity modes, thereby enhancing antenna performance. FIG. 11 is a graph showing how the real part β of the propagation constant for electromagnetic waves traveling within cavity 44 may vary as a function of operating frequency f. In the illustrative scenario of FIG. 11, it is desired to operate device 10 and antenna 40 in a frequency band FB extending from a lower band edge at low frequency $f_L$ to an upper band edge at high frequency $f_H$. With one suitable arrangement, low frequency $f_L$ may be 5.15 GHz and high frequency $f_H$ may be 5.85 GHz (e.g., the frequency band of interest may be associated with 802.11 5 GHz communications). Frequency band FB may, in general, correspond to a cellular telephone band, a wireless local area network band, or other communications band of interest.

In the propagation constant graph for cavity 44 of FIG. 11, curve 106 represents the propagation constant associated with a mode of order N and curve 108 represents the propagation constant associated with a successive mode of order N+1. Curve 106 may be characterized by a cutoff frequency fc1. Curve 108 may be characterized by a cutoff frequency fc2. In accordance with curves 106 and 108, cavity 44 will not support the N-order mode below frequency fc1 (i.e., the mode of order N will be cut off below fc1) and will not support the N+1 order mode below frequency fc2 (i.e., the mode of order N+1 will be cut off below fc2). The value of N may be one or may be another suitable integer (i.e., lower order modes may be supported by cavity 44 in addition to the mode of order N).

With the illustrative configuration shown in FIG. 11, band FB lies in the frequency range extending between frequency fc1 to fc2 (i.e., frequency fc1 is spaced below frequency $f_L$ and frequency fc2 is spaced above frequency $f_H$). The magnitudes of fc2$-f_H$ and $f_L-$fc1 may, for example, be equal or may be close to equal to each other (e.g., within 80% or within 20% of each other to center band FB within the spacing created between cutoff frequencies fc1 and fc2 for the two successive cavity modes N and N+1). This configuration enhances antenna performance by reducing frequency variations in cavity mode coupling.

In general, there are many potential locations for cutoff frequencies fc1 and fc2 relative to band FB. For example, it might be possible to configure cavity 44 so that fc1 falls within band FB or lies at the same frequency as lower band edge $f_L$. However, in situations such as these and in other situations that differ from the preferred arrangement of FIG. 11, the efficiency with which electromagnetic waves are coupled into cavity 44 (and not radiated by antenna 40) will vary considerably as a function of frequency f within band FB. The arrangement of FIG. 11 avoids these fluctuations.

The radio-frequency energy that is coupled into antenna 40 is ideally all radiated. In practice, however, some cavity modes will typically be supported (i.e., it may not be practical to ensure that the cutoff frequency for the lowest order mode is above $f_H$), leading to some unavoidable cavity mode signal losses. By configuring cavity 44 as shown in FIG. 11, however, any cavity losses that occur due to the coupling of radio-frequency electromagnetic signals into a supported cavity mode (e.g., mode N, represented by the overlap of curve 106 and active communications band FB) will be relatively constant as a function of operating frequency f. The presence of cavity 44 (and mode N) will therefore not impart undesirable cavity coupling resonances as a function of frequency f in band FB when cavity 44 is configured to exhibit cavity mode characteristics of the type shown in FIG. 11.

The foregoing is merely illustrative of the principles of this invention and various modifications can be made by those skilled in the art without departing from the scope and spirit of the invention.

What is claimed is:

1. A cavity antenna that is configured to operate in an electronic device within a frequency band extending from a lower band edge to an upper band edge, comprising:

a speaker box;

a conductive antenna cavity formed from conductive structures surrounding the speaker box; and an antenna resonating element on the speaker box, wherein the conductive structures are configured to cut off an electromagnetic mode of order N at a cutoff frequency that lies below the lower band edge and to cut off an electromagnetic mode of order N+1 at a cutoff frequency that lies above the upper band edge.

2. The cavity antenna defined in claim 1 wherein the speaker box has opposing upper and lower surfaces containing respective first and second metal plates.

3. The cavity antenna defined in claim 2 further comprising a conductive layer that electrically connects the first metal plate to the second metal plate.

4. The cavity antenna defined in claim 3 wherein the conductive layer comprises a strip of metal tape.

5. The cavity antenna defined in claim 4 wherein at least one of the conductive structures comprises metal electronic device housing structures.

6. The cavity antenna defined in claim 5 wherein at least one of the conductive structures comprises button structures.

7. The cavity antenna defined in claim 6 wherein the metal electronic device housing structures have an opening configured to form a speaker port for the speaker box and wherein the strip of metal tape has an opening that matches the opening in the metal electronic device housing structures.

8. An electronic device, comprising:

a conductive electronic device housing including an opening; and a cavity antenna having:

a speaker box configured to emit sound through the opening;

a conductive antenna cavity formed from conductive structures surrounding the speaker box including at least part of the conductive electronic device housing; and an antenna resonating element on the speaker box, wherein the conductive structures are configured to cut off an electromagnetic mode of order N at a cutoff frequency that lies below the lower band edge and to cut off an electromagnetic mode of order N+1 at a cutoff frequency that lies above the upper band edge.

9. The electronic device defined in claim 8 wherein the speaker box is hollow and has speaker box walls surrounding a hollow interior, the electronic device further comprising a speaker driver in the hollow interior.

10. The electronic device defined in claim 9 further comprising at least one metal member that forms part of the speaker box walls.

11. The electronic device defined in claim 10 further comprising a layer of metal tape that is electrically connected to the metal member.

12. The electronic device defined in claim 11 wherein the at least one metal member and the metal tape cover portions of the speaker box adjacent to the speaker driver and wherein the metal tape has an opening through which sound from the speaker driver passes.

13. The electronic device defined in claim 11 further comprising at least one additional metal member that forms part of the speaker box walls, wherein the speaker box has opposing upper and lower surfaces, and wherein the metal member forms part of the upper surface and the additional metal member forms part of the lower surface.

14. The electronic device defined in claim 13 wherein the speaker box has an elongated shape with first and second opposing ends and wherein the speaker driver, the metal member, and the additional metal member are located nearer to the first end than to the second end.

15. The electronic device defined in claim 14 further comprising a display and a display cover layer that covers the display.

16. The electronic device defined in claim 15 wherein a portion of the display cover layer overlaps the speaker box.

17. The electronic device defined in claim 16 wherein the speaker box is located in a corner portion of the conductive electronic device housing and wherein the conductive electronic device housing is configured to overlap at least three wall surfaces on the speaker box.

18. The electronic device defined in claim 8 wherein the antenna resonating element comprises a flexible printed circuit antenna resonating element.

19. The electronic device defined in claim 8 wherein the speaker box has an elongated length and has at least one wall running along the elongated length and wherein the conductive structures include a metal tape that covers only part of the elongated length so that some of the wall is uncovered by metal tape.

20. A method of operating a speaker box cavity antenna having a cavity formed from conductive structures surrounding a speaker box, comprising:

transmitting and receiving radio-frequency electromagnetic signals with the speaker box cavity antenna within a frequency band having a lower band edge and an upper band edge selected to cut off an electromagnetic mode of order N at a cutoff frequency that lies below the lower band edge and to cut off an electromagnetic mode of order N+1 at a cutoff frequency that lies above the upper band edge;

wherein transmitting and receiving the radio-frequency electromagnetic signals with the speaker box cavity antenna comprises using a flexible printed circuit antenna resonating element on the speaker box to transmit and receive signals.

* * * * *